US009914163B2

(12) United States Patent
Shiozaki et al.

(10) Patent No.: US 9,914,163 B2
(45) Date of Patent: Mar. 13, 2018

(54) METHOD OF SHEET FORMING

(71) Applicant: JFE STEEL CORPORATION, Tokyo (JP)

(72) Inventors: Tsuyoshi Shiozaki, Tokyo (JP); Yoshikiyo Tamai, Tokyo (JP); Toyohisa Shinmiya, Tokyo (JP); Shunsuke Tobita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 143 days.

(21) Appl. No.: 15/031,781

(22) PCT Filed: Aug. 11, 2014

(86) PCT No.: PCT/JP2014/071230
§ 371 (c)(1),
(2) Date: Apr. 25, 2016

(87) PCT Pub. No.: WO2015/064175
PCT Pub. Date: May 7, 2015

(65) Prior Publication Data

US 2016/0243604 A1 Aug. 25, 2016

(30) Foreign Application Priority Data

Oct. 30, 2013 (JP) ..... 2013-224855

(51) Int. Cl.
*B21D 22/02* (2006.01)
*B21D 47/00* (2006.01)
*B21D 22/26* (2006.01)

(52) U.S. Cl.
CPC ..... *B21D 22/02* (2013.01); *B21D 22/26* (2013.01); *B21D 47/00* (2013.01)

(58) Field of Classification Search
CPC ..... B21D 22/02; B21D 22/06; B21D 22/10; B21D 22/20; B21D 22/21; B21D 22/22;
(Continued)

(56) References Cited

U.S. PATENT DOCUMENTS 5,211,047 A * 5/1993 Kaneyuki ..... B21D 11/10 72/313
6,339,949 B1 * 1/2002 Takamatu ..... B21D 22/201 29/423

(Continued)

FOREIGN PATENT DOCUMENTS

CN 101786122 7/2010
CN 101868309 10/2010

(Continued)

OTHER PUBLICATIONS

Chinese Office Action with partial English language translation for Application No. 201480059025.7, dated Nov. 28, 2016, 7 pages.

(Continued)

*Primary Examiner* — R. K. Arundale
*Assistant Examiner* — Pradeep C Battula
(74) *Attorney, Agent, or Firm* — RatnerPrestia

(57) ABSTRACT

A method of sheet forming manufactures a sheet-formed part that is formed in an L-shape as viewed in a plan view and includes a top portion, side wall portions formed on the respective both sides of the top portion, and flange portions contiguously formed with the respective side wall portions, by sheet-forming a metal sheet with the a sheet forming tool. The method includes: a first sheet forming process in which the metal sheet is arranged on a first sheet forming tool including a first punch, a first die, a first blank holder, and a pad; and a second sheet forming process in which the first sheet-formed part formed is sheet-formed into a second sheet-formed part having a top portion and a side wall (Continued)

portion whose shapes are identical with those of the sheet-formed part, with a second sheet forming tool having a second punch and a second die.

8 Claims, 17 Drawing Sheets

(58) Field of Classification Search
CPC . B21D 22/26; B21D 5/01; B21D 5/04; B21D 25/00; B21D 25/02; B21D 25/04; B21D 24/02; B21D 24/04; B21D 53/88
See application file for complete search history.

(56) References Cited

U.S. PATENT DOCUMENTS

| | | | | |
|---|---|---|---|---|
| 7,971,467 | B2 * | 7/2011 | Yamada | B21D 5/01 72/356 |
| 8,250,896 | B2 | 8/2012 | Hirotani | |
| 8,850,864 | B2 | 10/2014 | Kubo | |
| 9,211,579 | B2 | 12/2015 | Tanaka | |
| 9,266,162 | B2 | 2/2016 | Tanaka et al. | |
| 2005/0229669 | A1 * | 10/2005 | Lanczy | B21D 5/01 72/353.2 |
| 2010/0186475 | A1 | 7/2010 | Hirotani | |
| 2010/0236318 | A1 | 9/2010 | Kubo | |
| 2012/0297853 | A1 * | 11/2012 | Tanaka | B21D 22/02 72/350 |
| 2013/0239645 | A1 * | 9/2013 | Tanaka | B21D 22/26 72/361 |
| 2014/0182349 | A1 | 7/2014 | Yonemura et al. | |

FOREIGN PATENT DOCUMENTS

| | | | | |
|---|---|---|---|---|
| CN | 102791396 | | 11/2012 | |
| DE | 19853130 | | 5/2000 | |
| EP | 2524740 | | 11/2012 | |
| JP | 64066024 | A | 3/1989 | |
| JP | 2008296252 | A | 12/2008 | |
| JP | 2009208149 | | 9/2009 | |
| JP | 2010120061 | | 6/2010 | |
| JP | 2010201486 | | 9/2010 | |
| JP | WO 2012070623 | A1 * | 5/2012 | B21D 22/26 |
| JP | 2012245536 | | 12/2012 | |
| WO | 2011145679 | | 11/2011 | |
| WO | 2012070623 | | 5/2012 | |
| WO | 2012161050 | A1 | 7/2014 | |

OTHER PUBLICATIONS

Supplementary European Search Report for Application No. EP 14858848.6, dated Jun. 1, 2017, 5 pages.
International Search Report and Written Opinion of the International Searching Authority for International Application No. PCT/JP2014/071230 dated Nov. 11, 2014.

* cited by examiner

METHOD OF SHEET FORMING

CROSS REFERENCE TO RELATED APPLICATIONS

This is the U.S. National Phase application of PCT International Application No. PCT/JP2014/071230, filed Aug. 11, 2014, and claims priority to Japanese Patent Application No. 2013-224855, filed Oct. 30, 2013, the disclosures of each of these applications being incorporated herein by reference in their entireties for all purposes.

FIELD OF THE INVENTION

The present invention relates to a method of sheet forming that is used for sheet-forming a metal sheet by a sheet forming tool to manufacture a sheet-formed part including a top portion, a side wall portion formed on each of both sides of the top portion, and a flange portion contiguously formed with the side wall portion, the sheet-formed part having an L-shape as viewed in a plan view.

BACKGROUND OF THE INVENTION

When generally manufacturing a product having an L-shaped portion, such as a front pillar reinforcement that is one of vehicle body frame parts in an automobile, by sheet-forming a metal sheet, a sheet forming tool constituted of a punch, a die, and a blank holder is used. In this case, the punch and the die are brought closer to each other in a state that the whole periphery of the metal sheet is held by the die and the blank holder to apply drawing to the metal sheet.

In such sheet forming, when sheet-forming an L-shaped part having a bent portion being bent steeply, wrinkles easily occur in a top portion of the L-shaped part. When the holding force by the die and the blank holder is increased, the wrinkles are reduced, while cracks easily occur in a shoulder portion or a side wall portion of the L-shaped part. In recent years particularly, in order to achieve the enhanced safety and the weight reduction of an automotive body, the strength of the metal sheet used as a blank has been increasingly enhanced and hence, it is impossible to expect a blank ductility equivalent to that of the conventional soft steel sheet. Accordingly, it is important to prevent cracks or wrinkles at the time of sheet forming.

As a technique of sheet-forming an L-shaped part, patent literature 1 proposes a method for draw-forming a blank shallowly first and thereafter, further bending-forming the blank by using another sheet forming tool to form the blank into a final product shape. Furthermore, as another technique with respect to a frame member having an L-shape, patent literature 2 proposes a method of sheet forming that uses a sheet forming tool unit constituted of a die, a pad, and a bending tool.

PATENT LITERATURE

Patent Literature 1: WO 2012/070623
Patent Literature 2: WO 2011/145679

SUMMARY OF THE INVENTION

In the techniques described in patent literatures 1 and 2, only the part whose L-shaped bending portion to be joined to other parts has a top portion, one side wall extending from the top portion, and one flange portion connected to the side wall can be formed, and an L-shaped part having a hat-shaped cross section extending over the entire length of the L-shaped part is incapable of being formed.

The present invention has been proposed to overcome such problems and it is an object of the present invention to provide a method of sheet forming capable of forming an L-shaped part having a hat-shaped cross section extending over the entire length of the L-shaped part even when a metal sheet composed of a high-strength steel sheet having ultrahigh strength of at least 980 MPa class and low ductility is used as a blank.

A method of sheet forming according to the present invention includes a method of sheet forming for manufacturing a sheet-formed part that is formed in an L-shape as viewed in a plan view and includes a top portion, side wall portions formed on the respective both sides of the top portion, and flange portions contiguously formed with the respective side wall portions, by sheet-forming a metal sheet with the a sheet forming tool, and includes: a first sheet forming process in which the metal sheet is arranged on a first sheet forming tool including a first punch, a first die, a first blank holder, and a pad so that a part corresponding to an end portion of a short side of the L-shape in the metal sheet does not overlap with the first die and the first blank holder, a part of the top portion is held by the pad, and the metal sheet is sheet-formed into a first sheet-formed part having an intermediate shape; and a second sheet forming process in which the first sheet-formed part formed in the first sheet forming process is sheet-formed into a second sheet-formed part having a top portion and a side wall portion whose shapes are identical with those of the sheet-formed part, with a second sheet forming tool having a second punch and a second die, wherein the side wall portion on an outer side that includes an L-shaped bent portion in the first sheet-formed part formed in the first sheet forming process is outwardly stretched in an arcuate shape as viewed in a plan view from the side wall portion of the sheet-formed part, a curvature radius of a circular arc of the side wall portion stretched in an arcuate shape is larger than a curvature radius of the L-shaped bent portion of the sheet-formed part, an outside of the top portion of the L-shaped bent portion is stretched from an outside of the top portion of the sheet-formed part, and a curvature radius in a cross section of a shoulder portion contiguously formed with the top portion stretched, as viewed in a side view, is larger than a curvature radius in a cross section of a shoulder portion contiguously formed with the outside of the top portion of the L-shaped bent portion of the sheet-formed part, as viewed in a side view.

In the method of sheet forming according to embodiments of the present invention, a part of the top portion held by the pad in the first sheet forming process includes at least the L-shaped bent portion, and is a part with which a stretching portion of the top portion in the first sheet-formed part does not interfere.

In the method of sheet forming according to embodiments of the present invention, a timing at which the pad is started to hold the metal sheet in the first sheet forming process is the timing at which the pad is positioned in a range from 0% position to 50% position with respect to a forming depth from a position where the first punch initiates a contact with the metal sheet to a bottom dead center position of the first punch.

In the method of sheet forming according to embodiments of the present invention, amounts of stretching of the side wall portion and the top portion in the first sheet forming process are each an amount that an area ratio of an area of a stretching portion of the L-shaped bent portion of the first sheet-formed part to an area of the L-shaped bent portion of the sheet-formed part corresponding to the stretching portion is increased by 0.3% to 1.2%.

According to embodiments of the present invention, the L-shaped part having a hat cross section extending over the entire length of the L-shaped part can be formed even when the metal sheet composed of the high-strength steel sheet having ultrahigh strength of at least 980 MPa class and low ductility is used as a blank.

DETAILED DESCRIPTION OF EMBODIMENTS OF THE INVENTION

Figure 1A:
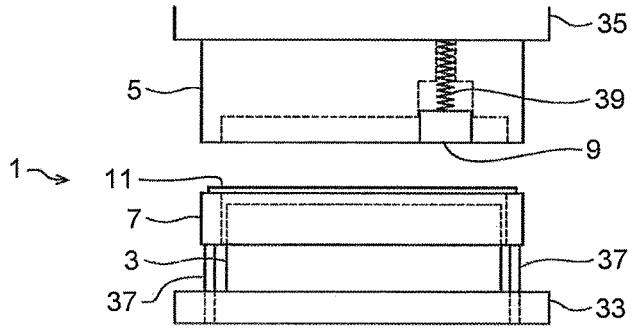
FIG. 1A is an explanatory view of a method of sheet forming according to one embodiment of the present invention.

Hereinafter, one embodiment of the present invention is specifically explained with reference to drawings. Here, the present invention is not limited to this embodiment. In the drawings, parts having identical functions are given same numerals.

Figure 1B:
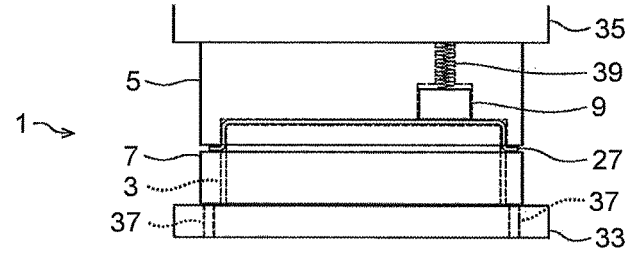
FIG. 1B is an explanatory view of the method of sheet forming according to the one embodiment of the present invention.
Figure 1C:
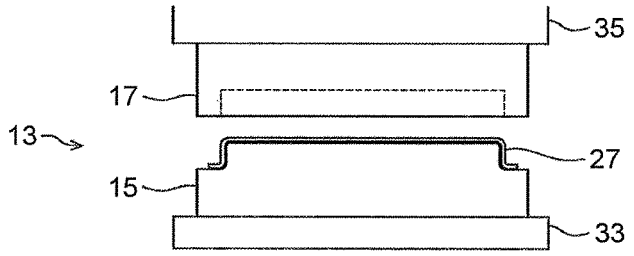
FIG. 1C is an explanatory view of the method of sheet forming according to the one embodiment of the present invention.
Figure 1D:
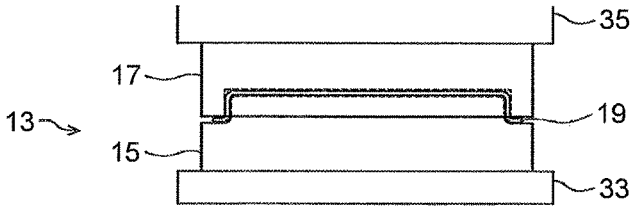
FIG. 1D is an explanatory view of the method of sheet forming according to the one embodiment of the present invention.
Figure 10:
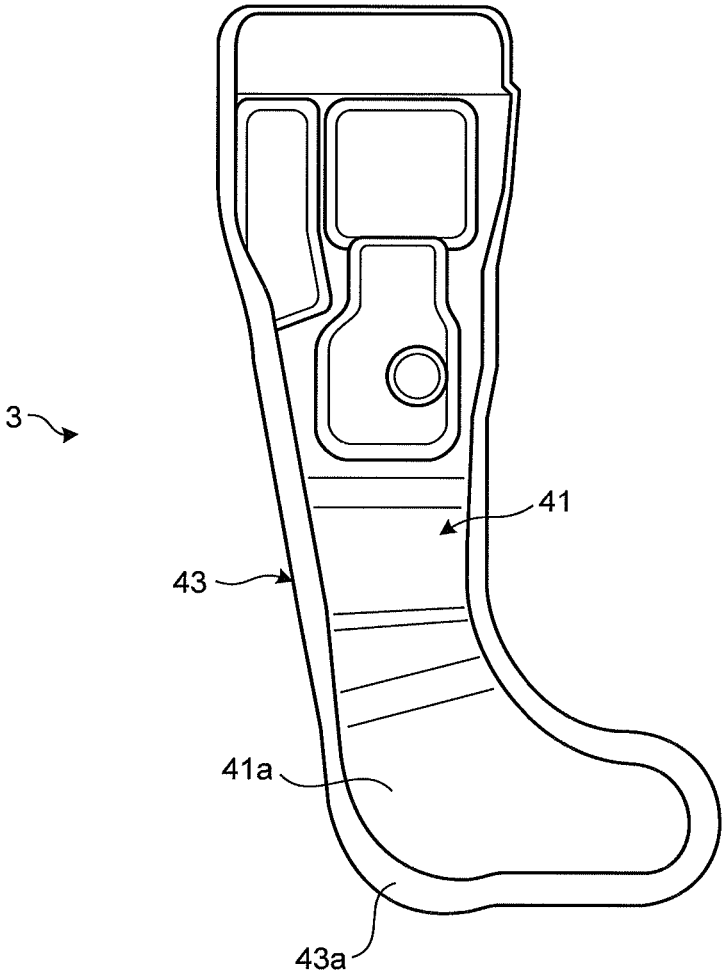
FIG. 10 is an explanatory view of the first sheet forming tool (the first punch) used in the first sheet forming process of the method of sheet forming according to the one embodiment of the present invention.

A method of sheet forming according to the one embodiment of the present invention includes a first sheet forming process illustrated in FIGS. 1A to 1B, and a second sheet forming process illustrated in FIGS. 10 to 1D. The first sheet forming process forms a metal sheet 11 into a first sheet-formed part 27 having an intermediate shape with a first sheet forming tool 1 including a first punch 3, a first die 5, a blank holder 7, and a pad 9. The second sheet forming process forms the first sheet-formed part 27 formed in the first sheet forming process into a second sheet-formed part having a product shape (identical with the shape of a sheet-formed part 19 with respect to a top portion and a side wall portion thereof) with a second sheet forming tool 13 having a second punch 15 and a second die 17. Accordingly, the sheet-formed part 19 that is a finished product illustrated in FIG. 2 and FIG. 3 is manufactured.

First of all, the sheet-formed part 19 that is a finished product, the first sheet-formed part 27 having an intermediate shape, and the second sheet-formed part having a product shape are explained. Next, the first sheet forming tool 1 and the second sheet forming tool 13 are explained. Thereafter, the method of sheet forming (the first sheet forming process, and the second sheet forming process) is explained.

Sheet-Formed Part

Figure 2:
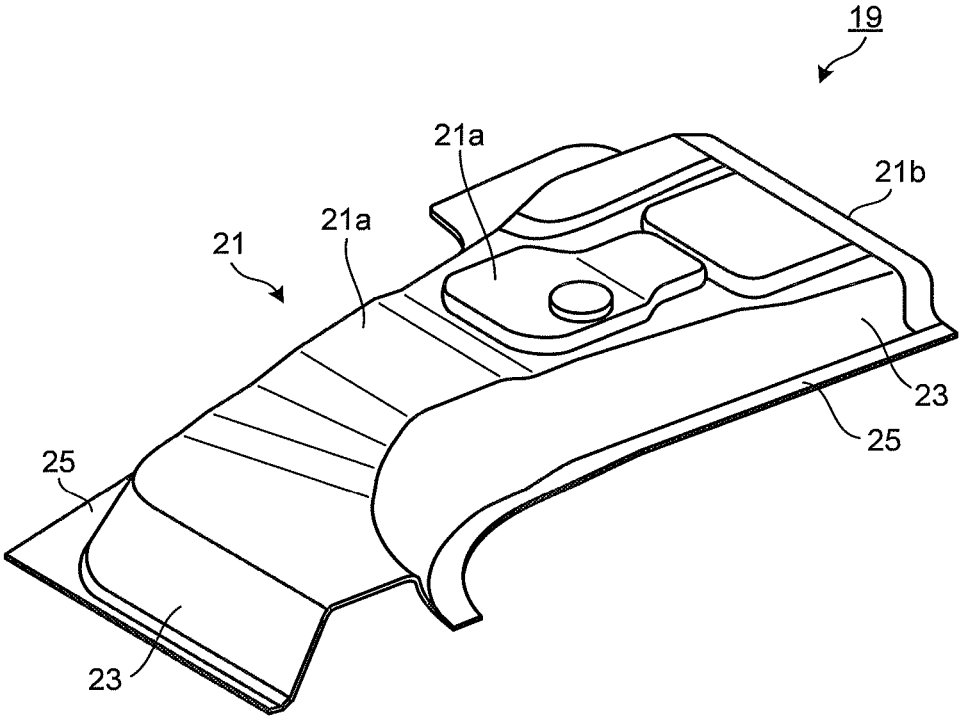
FIG. 2 is a perspective view of a sheet-formed part formed by the method of sheet forming according to the one embodiment of the present invention.
Figure 3:
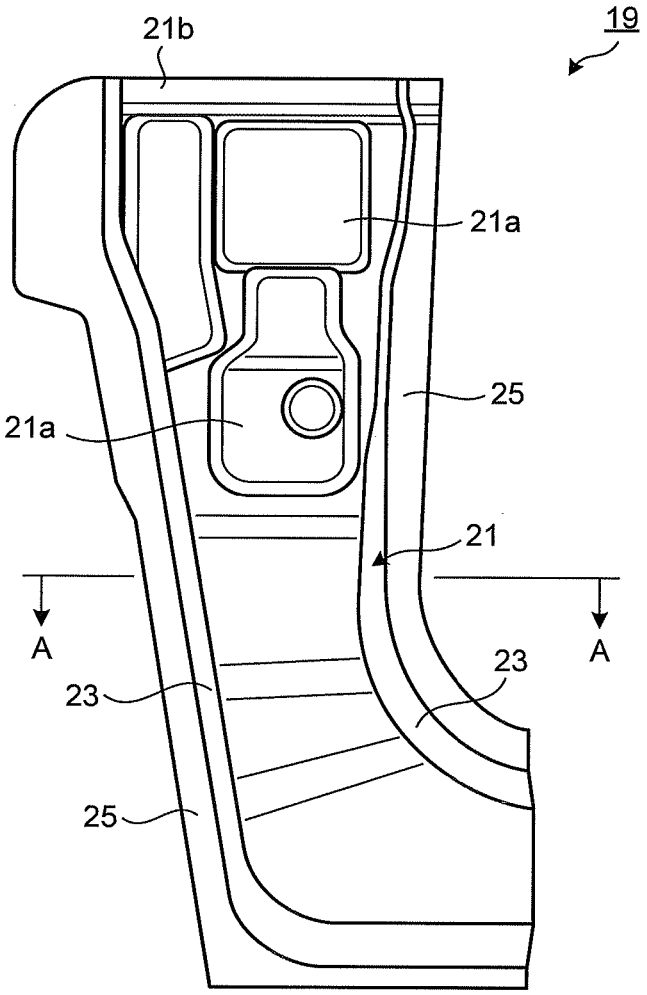
FIG. 3 is a plan view of the sheet-formed part formed by the method of sheet forming according to the one embodiment of the present invention.
Figure 4:
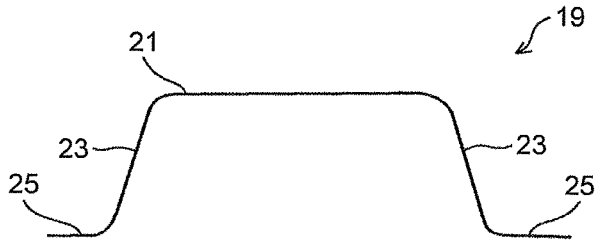
FIG. 4 is a cross-sectional view taken along a line A-A in FIG. 3.

The sheet-formed part 19 is, as illustrated in FIG. 2 and FIG. 3, provided with a top portion 21, side wall portions 23 formed on respective both sides of the sheet-formed part 19, and flange portions 25 contiguously formed with the respective side wall portions 23, and has an L-shape as viewed in a plan view (see FIG. 3). A cross section taken along a direction orthogonal to the axial direction on the plan view of the sheet-formed part 19 constitutes, for example, a hat shape extending over the entire length of the L-shape, as illustrated in FIG. 4.

The top portion 21 is formed in a L-shape constituted of long sides and short sides as viewed in a plan view. The top portion 21 has a plurality of convex portions 21*a*. The end portion of the short side forms a stepped portion thereon in such a manner that the end portion of the short side is shrunk, and the stepped portion constitutes a connection portion 21*b* for connection with another part. The side wall portion 23 and the flange portion 25 are not formed on the end portion of the short side. Here, the side wall portion 23 is inclined.

In this manner, the sheet-formed part 19 is a part that has a bent portion being bent steeply, and has a hat cross-sectional shape extending over the entire length thereof. Therefore, when the sheet-formed part 19 is manufactured by using a high-strength steel sheet having ultrahigh strength and low ductility in general sheet forming processes, wrinkles easily occur in the top portion 21 of an L-shaped bent portion, or cracks easily occur in a shoulder portion of the side wall portion 23 of the bent portion. Accordingly, in the present embodiment, in order to manufacture the sheet-formed part 19, as explained hereinafter, the first sheet-formed part 27 having an intermediate shape is first formed and thereafter, the second sheet-formed part having a product shape is formed from the first sheet-formed part 27.

First Sheet-Formed Part

Figure 5:
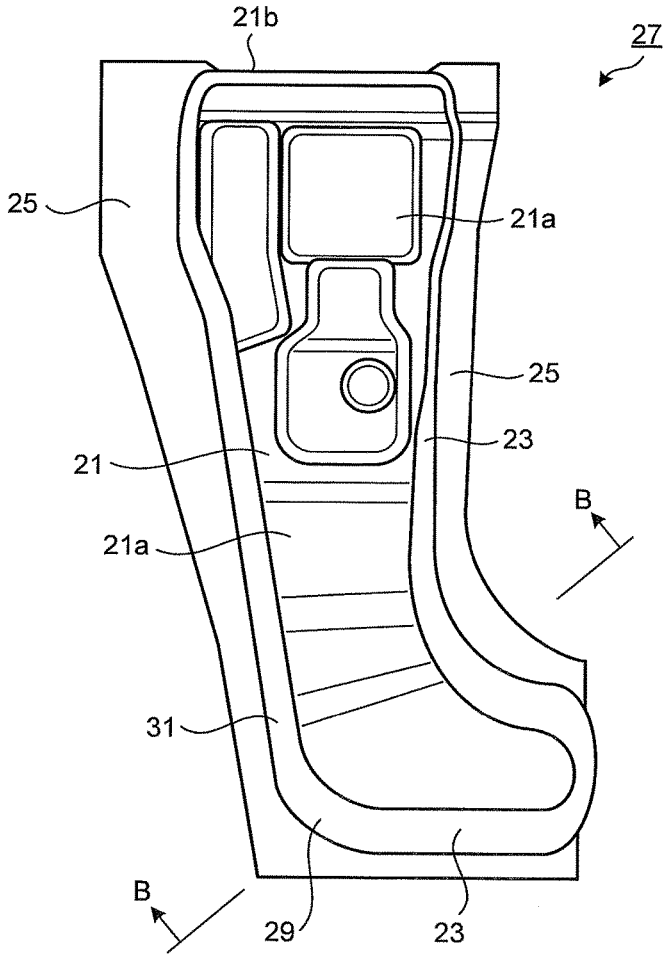
FIG. 5 is a plan view of a first sheet-formed part formed in a first sheet forming process of the method of sheet forming according to the one embodiment of the present invention.
Figure 6:
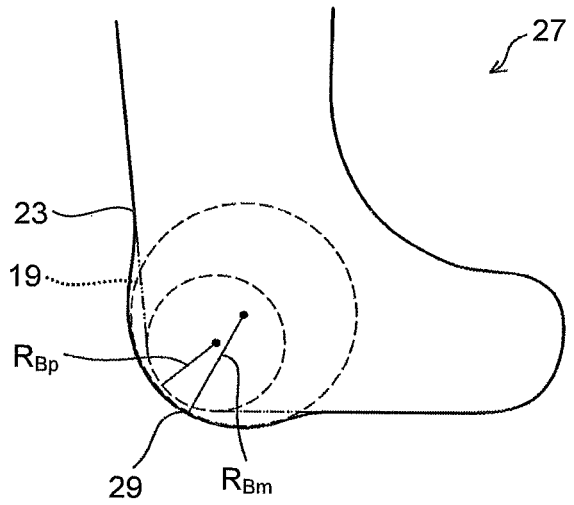
FIG. 6 is an explanatory view of an essential part of the first sheet-formed part formed in the first sheet forming process of the method of sheet forming according to the one embodiment of the present invention.
Figure 7:
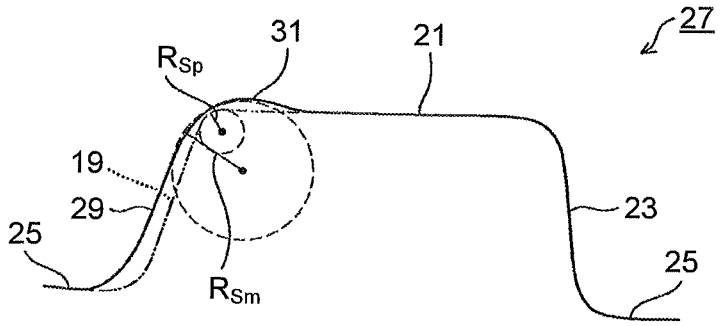
FIG. 7 is a cross-sectional view taken along a line B-B in FIG. 5, and also an explanatory view for explaining the essential part of the first sheet-formed part formed in the first sheet forming process of the method of sheet forming according to the one embodiment of the present invention.

The first sheet-formed part 27 is a part formed in the first sheet forming process. The first sheet-formed part 27 is explained based on FIG. 5 to FIG. 7. FIG. 5 is a plan view of the first sheet-formed part. FIG. 6 illustrates schematically a cross-sectional view taken along the direction orthogonal to the height direction at the center of the height of the side wall portion 23. FIG. 7 illustrates schematically a cross-sectional view taken along a line B-B in FIG. 5. In FIG. 6 and FIG. 7, the shape of the sheet-formed part 19 is indicated by a chain double-dashed line for comparison. Here, in FIG. 5 to FIG. 7, constitutional features identical with those of the sheet-formed part 19 (see FIG. 2 to FIG. 4) are given same numerals.

The first sheet-formed part 27 forms a side-wall stretching portion 29, which is outwardly stretched in an arcuate manner from the side wall portion 23 of the sheet-formed part 19 as viewed in a plan view, on the side wall portion 23 on an outer side that includes the L-shaped bent portion. Furthermore, as illustrated in FIG. 6, a curvature radius $R_{Bm}$ of the circular arc of the side-wall stretching portion 29 is set larger than an outer curvature radius $R_{Bp}$ of the L-shaped bent portion of the sheet-formed part 19. Here, the side wall portion 23 on an outer side is, as can be clearly understood from FIG. 6, a part of the side wall portion 23 located on the outside of the rounded portion in the L-shaped bent portion.

The first sheet-formed part 27 forms a top-portion stretching portion 31, which is stretched from the outside of the top portion 21 of the L-shaped bent portion of the sheet-formed part 19 in an arcuate manner as viewed in a side view, on the outside of the top portion 21 of the L-shaped bent portion. Furthermore, as illustrated in FIG. 7, a curvature radius $R_{Sm}$ in the cross section of a shoulder portion contiguously formed with the top-portion stretching portion 31 as viewed in a side view is set larger than a curvature radius $R_{Sp}$ in the cross section of a shoulder portion contiguously formed with the outside of the top portion 21 of the L-shaped bent portion of the sheet-formed part 19 as viewed in a side view.

As for the amounts of stretching of the side wall portion 23 and the top portion 21, it is desirable that the area of a stretching portion of the L-shaped bent portion of the first sheet-formed part 27 be increased by 0.3% to 1.2% by area ratio compared with the area of the L-shaped bent portion of the sheet-formed part 19 corresponding to the stretching portion. Here, the stretching portions mean the side-wall stretching portion 29 and the top-portion stretching portion 31, and the area of the stretching portion (in a side view and/or a plan view) means the sum total of the areas of the side-wall stretching portion 29 and the top-portion stretching portion 31. When the increase of the area ratio is less than 0.3%, it is impossible to avoid cracks. To consider a case where the increase of the area ratio exceeds 1.2%, when the first sheet-formed part 27 is formed into the sheet-formed part 19 in the second sheet forming process, there is a risk that the excessive material of the stretching portion causes the sheet-formed part 19 to be incomplete.

The shape of the first sheet-formed part 27 is substantially the same as the shape of the sheet-formed part 19 except for the side wall stretching portion 29 and the top-portion stretching portion 31.

Second Sheet-Formed Part

The second sheet-formed part is a part formed in the second sheet forming process, and has a product shape with respect to a top portion and a side wall portion thereof. (The shapes of the top portion and the side wall portion are identical with the respective shapes of the top portion 21 and the side wall portion 23 of the sheet-formed part 19.) Here, the shape of the second sheet-formed part is substantially the same as that of the sheet-formed part 19 illustrated in FIG. 2 and hence, the second sheet-formed part is not illustrated.

Next, the first sheet forming tool 1 and the second sheet forming tool 13 for forming the first sheet-formed part 27 and the second sheet-formed part, respectively, are explained.

First Sheet Forming Tool

Figure 8:
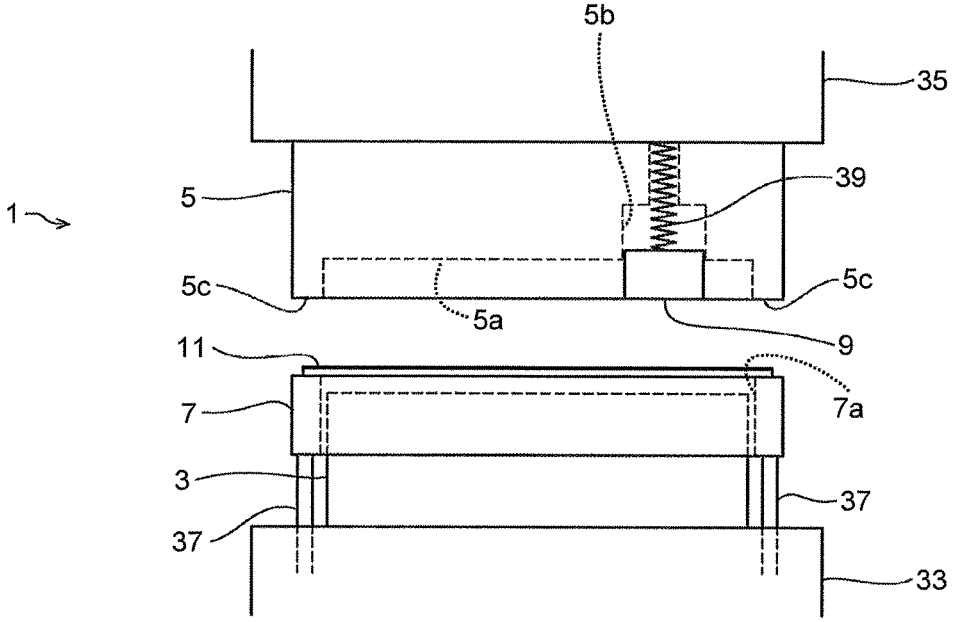
FIG. 8 is a side view with a part in the cross section of the first sheet forming tool used in the first sheet forming process of the method of sheet forming according to the one embodiment of the present invention.

The first sheet forming tool 1 is a sheet forming tool used for forming the metal sheet 11 into the first sheet-formed part 27 in the first sheet forming process. The first sheet forming tool 1 has, as illustrated in FIG. 8, the first punch 3, the first die 5, the blank holder 7 that sandwiches the metal sheet 11 in association with the first die 5, and the pad 9 that sandwiches a part of the metal sheets 11 in cooperation with the first punch 3. The first punch 3 is attached to a bolster 33, and the first die 5 is attached to a slider 35. Hereinafter, based on FIG. 8 to FIG. 11, each of the constitutional features of the first sheet forming tool 1 is explained in detail.

First Punch

Figure 9:
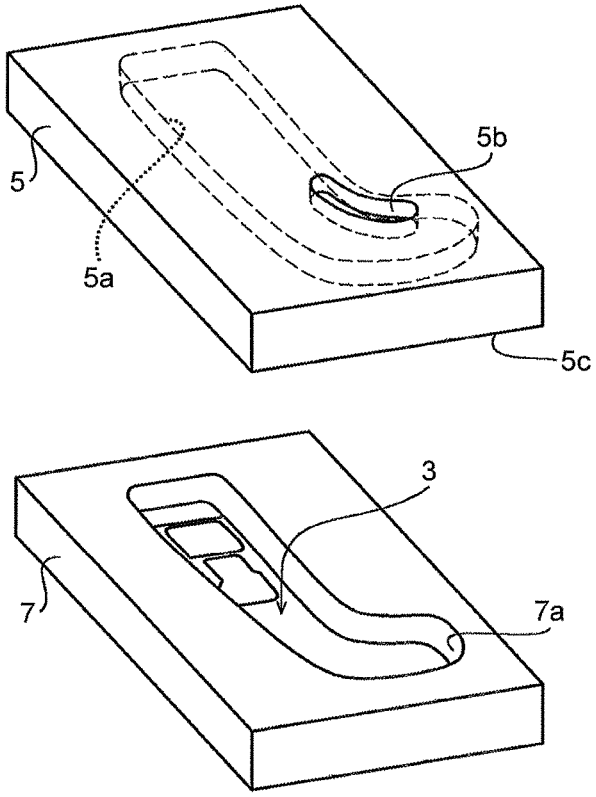
FIG. 9 is an explanatory view of the first sheet forming tool (a first punch, a first die, and a blank holder) used in the first sheet forming process of the method of sheet forming according to the one embodiment of the present invention.
Figure 11:
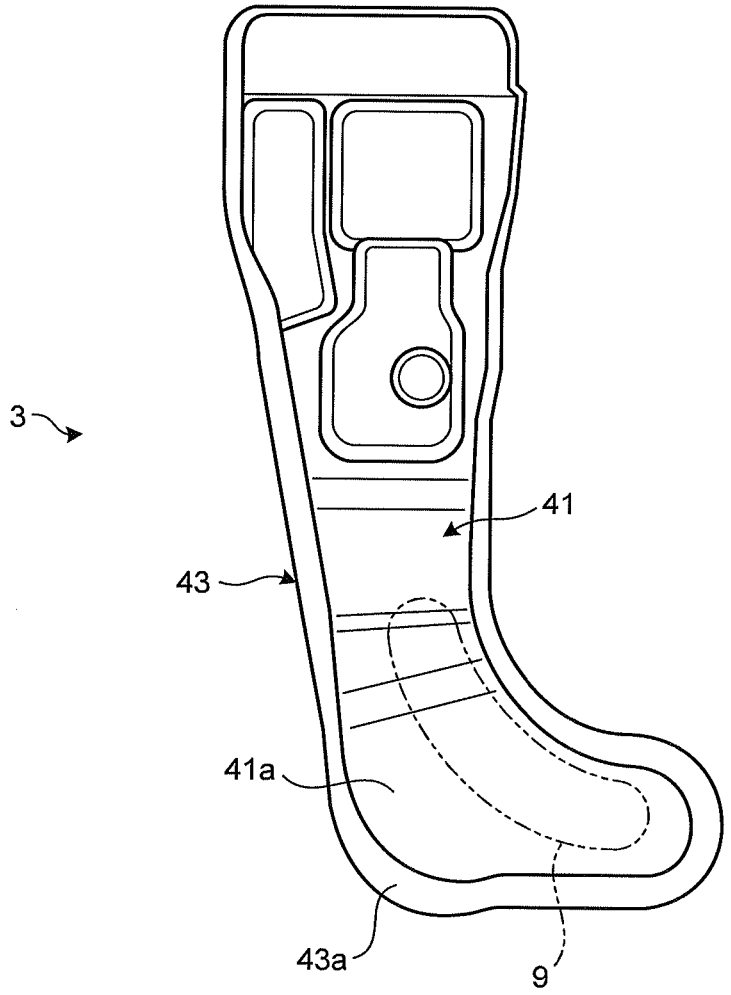
FIG. 11 is an explanatory view of an arrangement of a pad in the first sheet forming tool used in the first sheet forming process of the method of sheet forming according to the one embodiment of the present invention.

The first punch 3 has, as illustrated in FIG. 9 to FIG. 11, an L-shape as viewed in a plan view, and is provided with a top-portion forming surface portion 41 that forms the top portion 21, and a side-wall forming surface portion 43 that forms the side wall portion 23 around the top-portion forming surface portion 41. In FIG. 10 and FIG. 11, the side-wall forming surface portion 43 is inclined.

The top-portion forming surface portion 41 includes a top-portion stretching forming portion 41*a* for forming the top-portion stretching portion 31 of the first sheet-formed part 27, and the side-wall forming surface portion 43 includes a side-wall stretching forming surface portion 43*a* for forming the side wall stretching portion 29. The first punch 3 is formed into the above-mentioned shape and hence, in forming the first sheet-formed part 27 in the first sheet forming process, cracks of the shoulder portion contiguously formed with the outside of the top portion 21 in the L-shaped bent portion of the first sheet-formed part 27 can be avoided.

First Die

As illustrated in FIG. 9, the center portion of the first die 5 is recessed in a substantially L-shape, and the surface in the center portion recessed constitutes a forming surface 5*a* corresponding to the first punch 3. A pad housing portion 5*b* is provided to a location including the L-shaped bent portion in the forming surface 5*a*, and the pad 9 is arranged in the pad housing portion 5*b* (see FIG. 8). A surface around the forming surface 5*a* of the first die 5 constitutes a sandwiching surface 5*c* that sandwiches the metal sheet 11 in association with the blank holders 7.

Blank Holder

As illustrated in FIG. 8, the blank holder 7 is supported by cushion pins 37 in a vertically movable manner. Furthermore, as illustrated in FIG. 8 and FIG. 9, a punch housing portion 7*a* is provided to the center portion of the blank holder 7, and the first punch 3 is arranged in the punch housing portion 7*a*. The blank holder 7 is supported so that the blank holder 7 is located above the upper surface of the first punch 3 before staring a sheet forming process, and can be downwardly moved by the first die 5 at the time of sheet forming. When the blank holder 7 is downwardly moved, the first punch 3 is relatively projected from the blank holder 7, and the upper portion of the first punch 3 is inserted into the first die 5.

Pad

As illustrated in FIG. 8, the pad 9 is arranged so that the pad 9 can be depressed toward the first-punch-3 side by a spring 39, and sandwiches the metal sheet 11 in cooperation with the first punch 3. The pad 9 is formed in such a shape that the pad 9 is capable of depressing an area indicated by a chain double-dashed line in FIG. 11. That is, the pad 9 is capable of depressing an area corresponding to the location that includes at least the L-shaped bent portion in the area corresponding to the top portion 21 of the first sheet-formed part 27 in FIG. 5, and does not overlap with a stretching location (top-portion stretching portion 31) in the L-shaped bent portion of the first sheet-formed part 27. Due to such constitution, the occurrence of wrinkles in the inside of the L-shaped bent portion of the top portion 21 can be prevented.

Second Sheet Forming Tool

Figure 12:
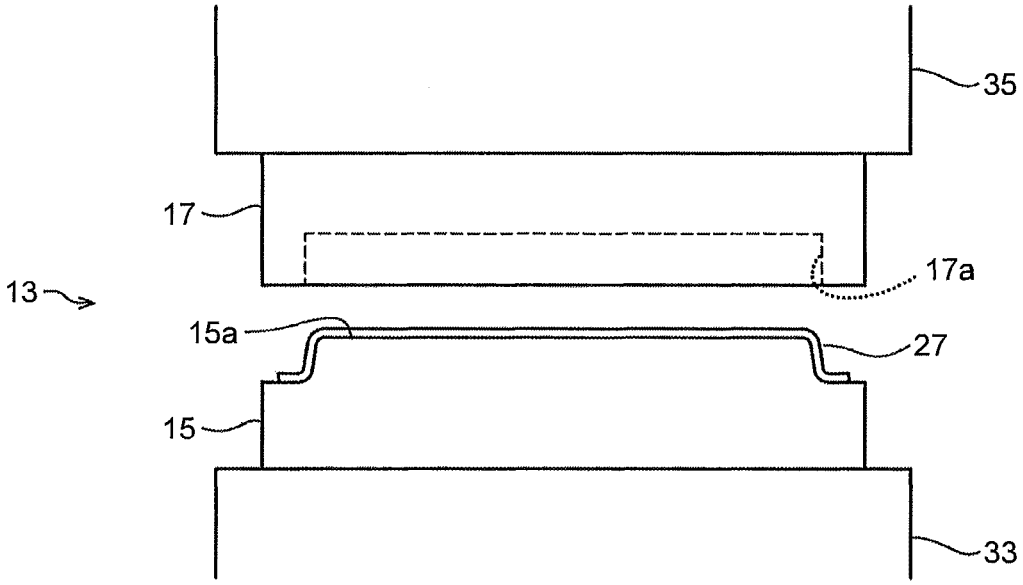
FIG. 12 is a side view with a part in the cross section of a second sheet forming tool used in a second sheet forming process of the method of sheet forming according to the one embodiment of the present invention.

The second sheet forming tool 13 is a sheet forming tool that forms the first sheet-formed part 27 into the second sheet-formed part in the second sheet forming process, and has the second punch 15 and the second die 17 as illustrated in FIG. 12. The second punch 15 is attached to the bolster 33, and the second die 17 is attached to the slider 35. Hereinafter, each of the constitutional features of the second sheet forming tool 13 is explained.

Second Punch

The second punch 15 has a forming surface 15*a* that forms the second sheet-formed part having a product shape, and presses and shrinks the stretching portion (the side-wall stretching portion 29 and the top-portion stretching portion 31) (see FIG. 5 to FIG. 7) of the first sheet-formed part 27 thus forming the second sheet-formed part having the product shape.

Second Die

The second die 17 has a forming surface 17*a* corresponding to the forming surface 15*a* of the second punch 15, and forms the first sheet-formed part 27 into the second sheet-formed part in cooperation with the second punch 15. Here, in the second die 17, a knock-out pin that easily ejects a product may be, as required, arranged when the second sheet-formed part adheres to the forming surface 17*a* after forming.

Method of Sheet Forming

Next, the method of sheet forming (the first sheet forming process, and the second sheet forming process) according to embodiments of the present invention is explained.

First Sheet Forming Process

In the first sheet forming process, the metal sheet 11 is set to the first sheet forming tool 1 illustrated in FIG. 8, and a part of the top portion 21 is held by the pad 9 to sheet-form the metal sheet 11 into the first sheet-formed part 27. Hereinafter, the first sheet forming process is more specifically explained.

Figure 13:
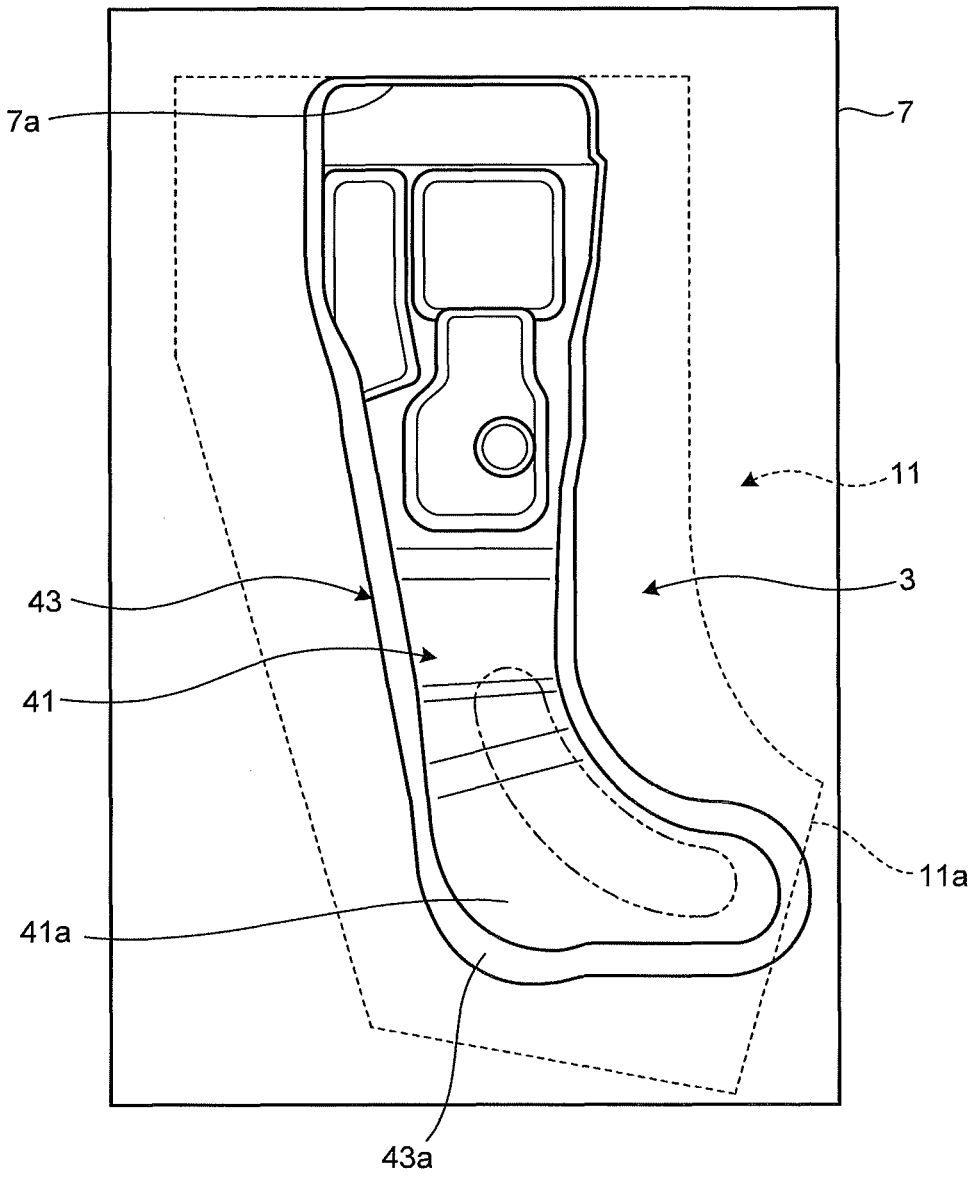
FIG. 13 is an explanatory view of an arrangement of a metal sheet in the first sheet forming process of the method of sheet forming according to the one embodiment of the present invention.

As illustrated in FIG. 13, the metal sheet 11 is arranged so that an area 11*a* corresponding to the short-side end portion of the L-shape of the second sheet-formed part in the metal sheet 11 does not overlap with the blank holder 7. When the metal sheet 11 is sheet-formed in a state that the area 11*a* corresponding to the short-side end portion overlaps with the blank holder 7, a load on the metal sheet 11 becomes large in the area 11*a* and hence, cracks occur in an area corresponding to the shoulder portion of the first punch 3 in the metal sheet 11, or wrinkles occur in the flange portion 25 (see FIG. 5) in the vicinity of the corner of the L-shape. Accordingly, the metal sheet 11 is arranged as described above to avoid the occurrence of cracks or wrinkles.

As illustrated in FIG. 1A to FIG. 1B, when the metal sheet 11 is set, the first die 5 and the blank holder 7 sandwich the metal sheet 11 therebetween. Due to such process, the occurrence of wrinkles in the flange portion 25 is prevented. To consider a case where the metal sheet 11 is not sandwiched between the first die 5 and the blank holder 7, when the first punch 3 is pressed into the first die 5, a portion, which is capable of being freely moved, of the metal sheet 11 in the vicinity of the shape changing portion of a sheet-formed part flows into the first die 5 and hence, wrinkles easily occur. Particularly, in the vicinity of the end portion of the metal sheet 11 that constitutes the flange portion 25 of the sheet-formed part, the metal sheet 11 is easily deformable and hence, large wrinkles occur. Accordingly, it is necessary to hold the metal sheet 11 between the first die 5 and the blank holder 7 from the early stage of sheet forming. Here, it is desirable to set a mean pressure (blank holder pressure) at which the metal sheet 11 is held between the first die 5 and the blank holder 7 to 0.7 MPa or higher.

When the metal sheet 11 is sandwiched between the first die 5 and the blank holder 7, the first die 5 is downwardly moved and hence, the first punch 3 is pressed on the metal sheet 11 to perform sheet forming. While the sheet forming is performed, a part of the top portion 21 in the metal sheet 11 is held by the pad 9. Here, the part of the top portion 21 is an area that includes at least the L-shaped bent portion, and does not interfere with the top-portion stretching portion 31 in the first sheet-formed part 27. In this manner, the metal sheet 11 is held by the pad 9 thus effectively preventing the occurrence of wrinkles in the L-shaped bent portion. As described above, the area 11*a* corresponding to the short-side end portion of the second sheet-formed part in the metal sheet 11 is arranged so that the area 11*a* does not overlap with the blank holder 7 and hence, the metal sheet 11 that is a material moves to the bent portion while the sheet forming is performed, and wrinkles easily occur. Accordingly, in embodiments of the present invention, in order to prevent the occurrence of wrinkles, the metal sheet 11 is held by the pad 9. When an area of the metal sheet 11 that is held by the pad 9 is set so that the area possesses a range within at least the L-shaped bent portion, the occurrence of wrinkles is prevented. The top portion 21 may be held in the wider range thereof. The area of the metal sheet 11 that is held by pad 9 is set so that the area does not interfere with the top-portion stretching portion 31 (see FIG. 7).

In a forming depth to the bottom dead center position of the pad 9, a position where the first punch 3 initiates a contact with the metal sheet 11 is set to 0%, and the bottom dead center position of the pad 9 is set to 100%. In that case, as for the timing at which the pad 9 holds the metal sheet 11, it is preferable that the pad 9 start to hold the metal sheet 11 when the first punch 3 is located at a position in the range from 0% to 50% of the forming depth. Here, in the explanation made hereinafter, a pad holding start timing means the timing at which the pad 9 starts to hold the metal sheet 11.

In the case where the pad holding start timing is a timing when the first punch 3 is located at the position of 0% or later of the forming depth, the swelling of the metal sheet 11 in the top portion 21 that starts from the early stage of contact between the first punch 3 and the metal sheet 11 is thus effectively prevented the occurrence of wrinkles. Hereinafter, the position of 0% of the forming depth is merely described as "0% position", and other positions are described in the same manner as above. On the other hand, in the case where the pad holding start timing is a timing when the first punch 3 is located at the position prior to the 0% position (−100% (minus 100%) position, for example), the pad 9 presses the metal sheet 11 in the direction toward the first punch 3 before the first die 5 and the blank holder 7 sandwich the metal sheet 11 therebetween. This case is undesirable since the displacement of the metal sheet 11 occurs and causes excessive leftover materials with respect to the shape of a formed part.

Furthermore, when the first punch 3 and the pad 9 start to hold the metal sheet 11 after the first punch 3 passes through a 50% position of the forming depth, wrinkles due to enlarged wavelike swelling in the top portion 21 are incapable of being prevented and hence, it is preferable that the pad holding start timing be set to a timing when the first punch 3 is located at the 50% position or does not pass through the 50% position.

It is desirable that the mean pressure (pad pressure) applied to the metal sheet 11 when the first punch 3 and the pad 9 hold the metal sheet 11 be set to 3 MPa or higher. Due to such constitution, the occurrence of wrinkles in the top portion 21 can be prevented.

In this manner, the first sheet-formed part 27 is formed. The side-wall stretching portion 29 and the top-portion stretching portion 31 (see FIG. 5 to FIG. 7) are formed in the bent portion of the first sheet-formed part 27, the bent portion has a curvature smaller than that of the shape of the bent portion of the sheet-formed part 19 and hence, the occurrence of cracks is prevented in the L-shaped bent portion.

Second Sheet Forming Process

The second sheet forming process is a sheet-forming process in which the first sheet-formed part 27 formed in the first sheet forming process is formed into the second sheet-formed part with the second sheet forming tool 13. First of all, as illustrated in FIG. 1C, the first sheet-formed part 27 is placed on the second punch 15. In this state, as illustrated in FIG. 1D, the second die 17 is moved downwardly and hence, the side-wall stretching portion 29 and the top-portion stretching portion 31 of the first sheet-formed part 27 are pressed and shrunk to form the first sheet-formed part 27 into the second sheet-formed part. Thereafter, the unnecessary portions around the second sheet-formed part are cut off (trimmed) to be the first sheet-formed part 19.

As mentioned above, in the present embodiment, the metal sheet 11 is sheet-formed into the first sheet-formed part 27 having an intermediate shape in the first sheet forming process. Next, in the second sheet forming process, the first sheet-formed part 27 formed in the first sheet forming process is sheet-formed into the second sheet-formed part having the top portion 21 and the side wall portion 23 each of which has a product shape. In the first sheet-formed part 27, the side wall portion 23 on an outer side that includes the L-shaped bent portion is outwardly stretched in an arcuate shape from the side wall portion 23 of the sheet-formed part 19 as viewed in a plan view. The curvature radius $R_{Bm}$ of the circular arc of the side wall portion 23 stretched in an arcuate shape is larger than the curvature radius $R_{Bp}$ of the L-shaped bent portion of the sheet-formed part. Furthermore, the outside of the top portion 21 of the L-shaped bent portion is stretched from the outside of the top portion 21 of the sheet-formed part 19. The curvature radius $R_{Sm}$ in the cross section of the shoulder portion contiguously formed with the top portion 21 stretched as viewed in a side view is larger than the curvature radius $R_{Sp}$ in the cross section of the shoulder portion contiguously formed with the outside of the top portion 21 of the L-shaped bent portion of the sheet-formed part 19 as viewed in a side view. Accordingly, even when the metal sheet composed of a high-strength steel sheet having ultra-high strength and low ductility is used as a blank material, the sheet-formed part 19 that is an L-shaped part having a hat cross section extending over the entire length of the L-shaped part is precisely and stably formed without the occurrence of cracks in the L-shaped bent portion.

Here, the explanation above has been made with respect to the example such that the pad 9 presses the metal sheet 11 by using the spring 39. However, as in examples described later, the pad 9 may press the metal sheet 11 by using a gas cylinder.

Furthermore, as described above, the explanation has been made with respect to the example such that the second sheet-formed part is trimmed after the second sheet forming process to form the sheet-formed part 19. However, the timing when the second sheet-formed part is trimmed is not limited to this example. For example, the first sheet-formed part 27 may be trimmed after the first sheet forming process, and again the second sheet-formed part is trimmed after the second sheet forming process as finishing.

EXAMPLES

The specific experiments were performed in order to confirm the manner of operation and advantageous effects by the method of sheet forming of the present invention. In the experiments, in order to manufacture a front pillar reinforcement (hereinafter, referred merely to as "front pillar 51") of an automotive body that is a part formed in a L-shape illustrated in FIG. 14, the first sheet-formed parts were formed under various sheet forming conditions to form the second sheet-formed parts. Furthermore, each of the second sheet-formed parts was trimmed to manufacture the front pillar 51, and wrinkles or cracks of each front pillar 51 manufactured were evaluated.

Hereinafter, the explanation is made with respect to the front pillar 51 (see FIG. 14 and FIG. 15) that is a completed part, a sheet forming tool (see FIG. 16 to FIG. 22) for sheet-forming a first sheet-formed part and a second sheet-formed part of the front pillar 51. Thereafter, the explanation is specifically made with respect to the sheet forming conditions (see Table 1, FIG. 23A, FIG. 23B, FIG. 24A, and FIG. 24B) in the first sheet forming process, and the evaluation results (see Table 2) of the front pillar 51 manufactured. Here, the first sheet-formed part and the second sheet-formed part are identical with the respective first and second sheet-formed parts in the above-mentioned embodiment, and their detailed explanations are omitted.

Figure 14:
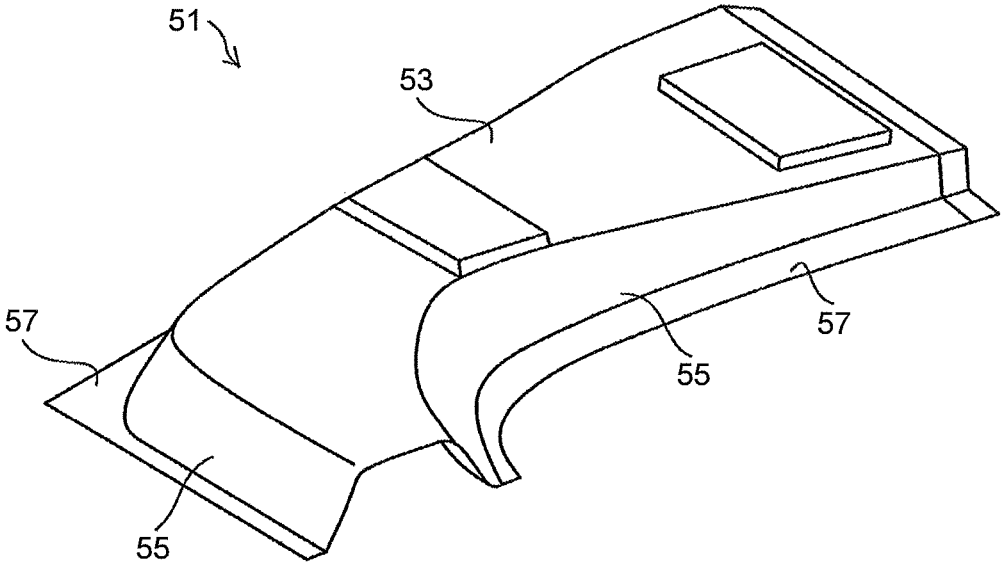
FIG. 14 is a perspective view of a second sheet-formed part (a front pillar) formed by a method of sheet forming according to an example of the present invention.
Figure 15:
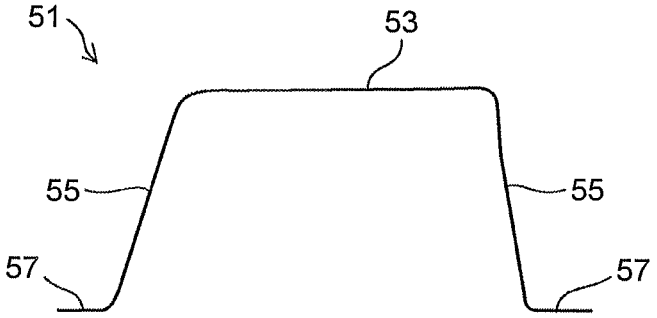
FIG. 15 illustrates one example of a cross-sectional view taken along a direction orthogonal to the axial direction on the plan view of the second sheet-formed part (the front pillar) formed by the method of sheet forming according to the example of the present invention.

First of all, the front pillar 51 is explained. The front pillar 51 has, as illustrated in FIG. 14, a top portion 53 that is formed in an L-shape and constituted of a long side and a short side as viewed in a plan view, side wall portions 55 formed around the top portion 53, and flange portions 57 contiguously formed with the respective side wall portions 55. Furthermore, as illustrated in FIG. 15, the front pillar 51 is formed in a substantially hat shape extending over the entire length thereof in a cross section taken along a direction orthogonal to the axial direction as viewed in a plan view. The side wall portion 55 and the flange portion 57 are not formed on the short side end portion of the top portion 53.

Next, the explanation is made with respect to a sheet forming tool (a first sheet forming tool, and a second sheet forming tool) used for sheet forming. In the first sheet forming process, the first sheet forming tool (a blank holder 61, a first punch 65, a first die 69, and a pad 73) illustrated in FIG. 16 to FIG. 19 was used. The first punch 65 has, as illustrated in FIG. 16, an L-shape as viewed in a plan view.

Figure 16:
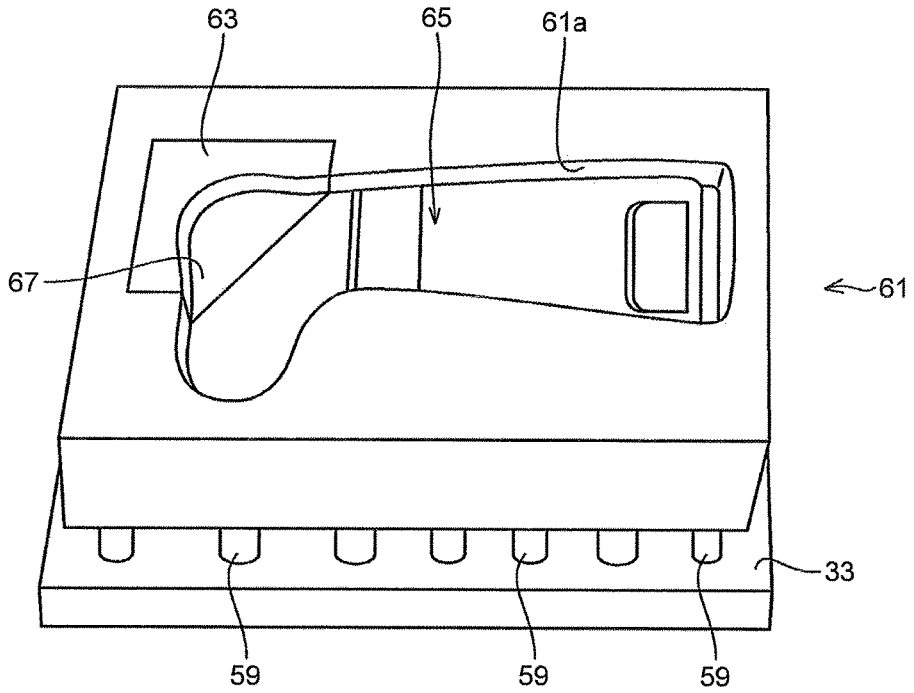
FIG. 16 is an explanatory view of a first sheet forming tool (a first punch, and a blank holder) used in a first sheet forming process of the method of sheet forming according to the example of the present invention.

The blank holder 61 is, as illustrated in FIG. 16, supported by cushion pins 59. A punch housing portion 61*a* is arranged in the center portion of the blank holder 61, and the first punch 65 having an L-shape as viewed in a plan view is arranged in the punch housing portion 61*a*. In order to perform experiments in which stretching portions (a side wall stretching portion and a top-portion stretching portion) of the first sheet-formed part are changed, the first punch 65 has a replaceable portion 67 arranged on a part corresponding to the outside of an L-shaped bent portion.

Figure 17:
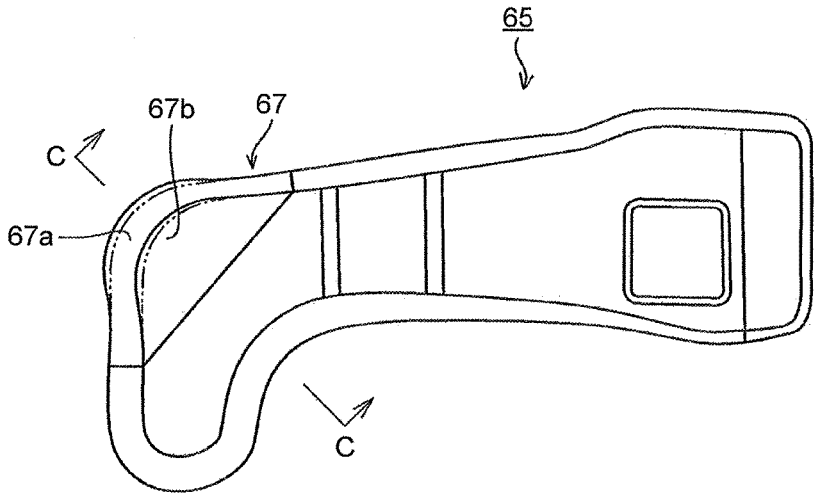
FIG. 17 is an explanatory view of the first sheet forming tool (the first punch) used in the first sheet forming process of the method of sheet forming according to the example of the present invention.
Figure 18:
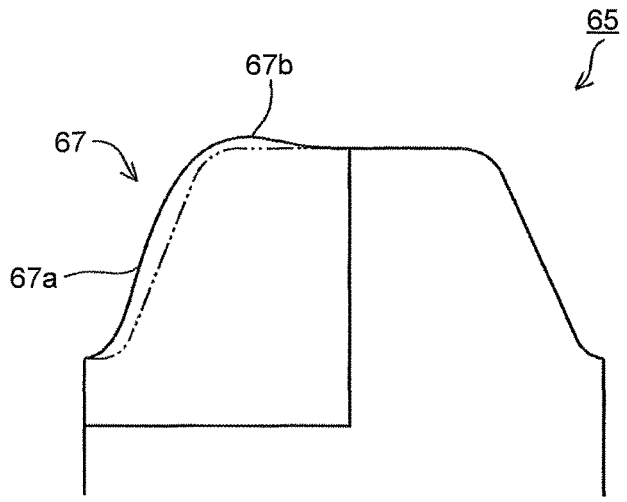
FIG. 18 is a cross-sectional view taken along a line C-C in FIG. 17.

In the replaceable portion 67, as illustrated in FIG. 17 and FIG. 18 (a cross-sectional view taken along a line C-C in FIG. 17), a side-wall stretching forming portion 67*a* and a top-portion stretching forming portion 67*b* are formed and hence, the shape or the amount of stretching of each stretching portion (the side-wall stretching portion and the top-portion stretching portion) can be changed by replacing the replaceable portion 67 with an optional part. For example, when the side-wall stretching forming portion 67*a* is not formed, the side-wall stretching portion is not formed while only the top-portion stretching portion is formed, and when the size of the top-portion stretching forming portion 67*b* is changed, the amount of stretching of the top-portion stretching portion is changed. The blank holder 61 has a replaceable portion 63 (see FIG. 16) arranged on a part corresponding to the outside of the L-shaped bent portion, and the replaceable portion 63 is capable of being changed in accordance with the shape of the replaceable portion 67 of the first punch 65.

Figure 19:
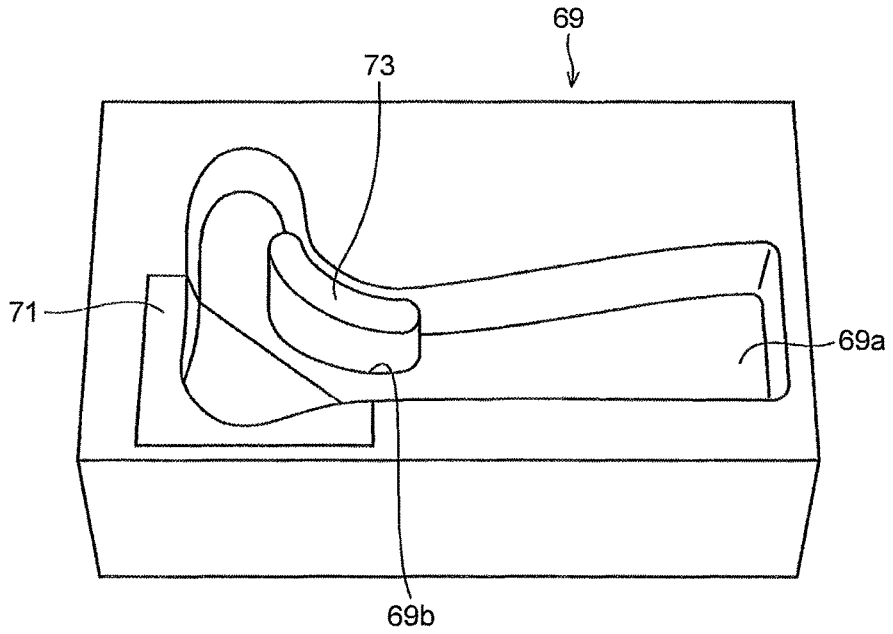
FIG. 19 is an explanatory view of the first sheet forming tool (a first die, and a pad) used in the first sheet forming process of the method of sheet forming according to the example of the present invention.
Figure 20:
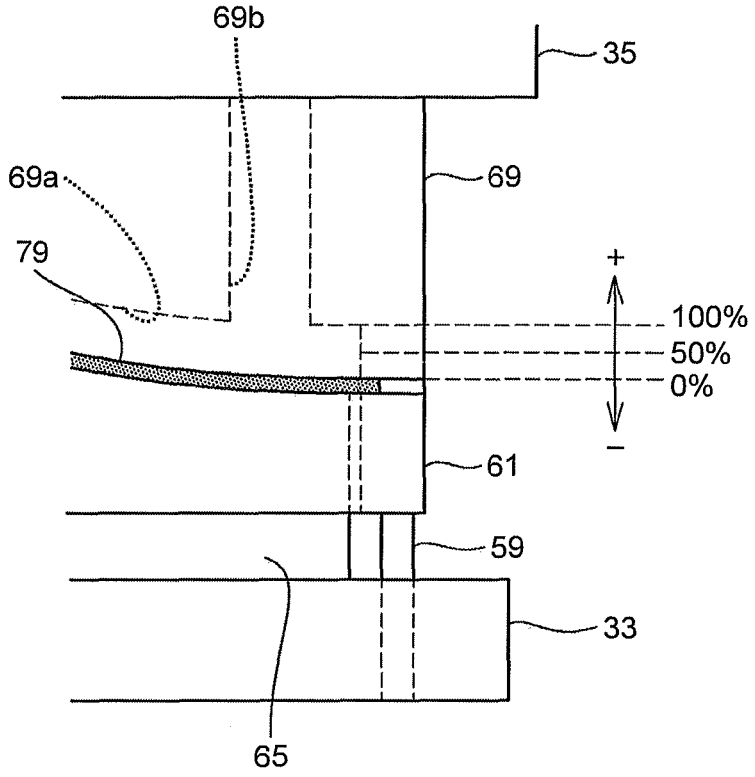
FIG. 20 is an explanatory view of a pad holding timing in the first sheet forming process of the method of sheet forming according to the example of the present invention.

The first die 69 has, as illustrated in FIG. 19, a recessed portion 69*a* into which the first punch 65 is inserted. A pad housing portion 69*b* is provided to the bottom surface of the recessed portion 69*a* of the first die 69, and the pad 73 is arranged in the pad housing portion 69*b*. The first die 69 has a replaceable portion 71 corresponding to the replaceable portion 63 of the blank holder 61 and the replaceable portion 67 of the first punch 65. The first die 69 is, as illustrated in FIG. 20, attached to the slider 35. The pad 73 is connected to the gas cylinder (not illustrated in the drawings) arranged in the slider 35 so that a load is generated, and metal blocks (not illustrated in the drawings) different in thickness from each other that are capable of being inserted between the slider 35 and the gas cylinder are replaced with each other thus adjusting the projecting position of the pad 73.

Figure 21:
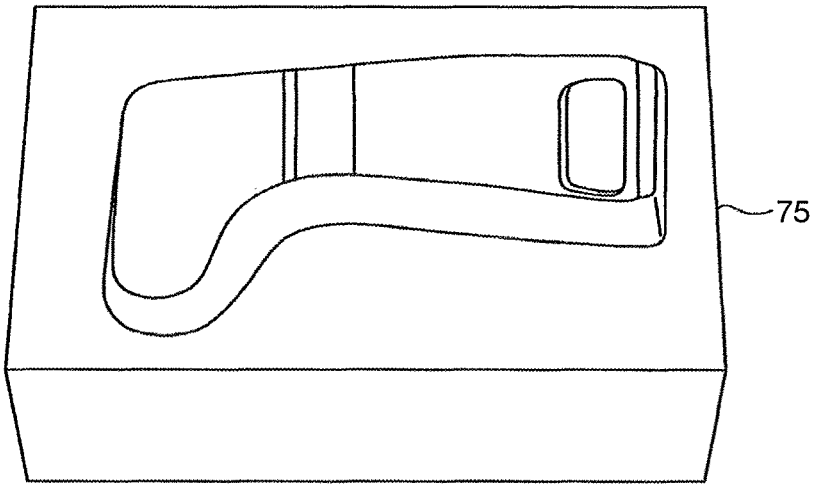
FIG. 21 is an explanatory view of a second sheet forming tool (a second punch) used in a second sheet forming process of the method of sheet forming according to the example of the present invention.
Figure 22:
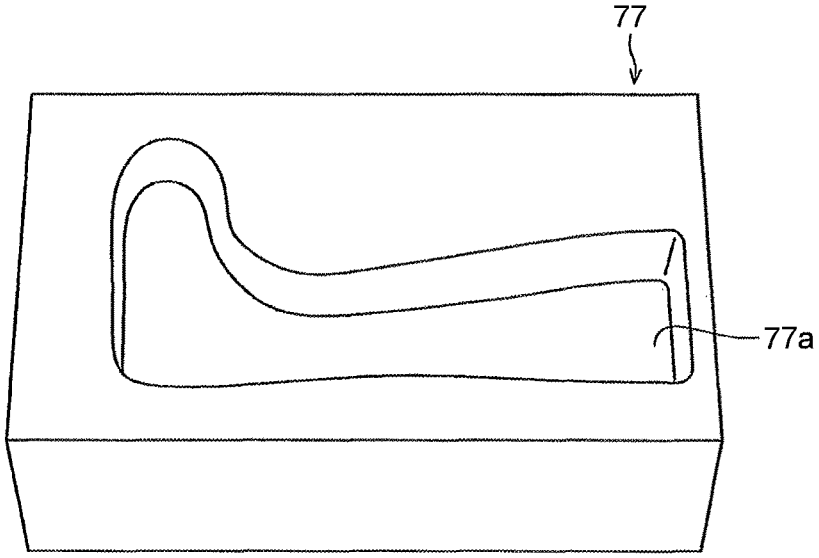
FIG. 22 is an explanatory view of the second sheet forming tool (a second die) used in the second sheet forming process of the method of sheet forming according to the example of the present invention.

In the second sheet forming process, the second sheet forming tool (a second punch 75, and a second die 77) illustrated in FIG. 21 and FIG. 22 was used. The part of the second punch 75 that corresponds to a stretching portion of the first sheet-formed part is, as illustrated in FIG. 21, formed in a product shape so that the stretching portion (a side-wall stretching portion and a top-portion stretching portion) of the first sheet-formed part is formed in the product shape. The second die 77 has, as illustrated in FIG. 22, a recessed portion 77*a* into which the second punch 75 is inserted.

Next, sheet forming conditions in the first sheet forming process are explained in detail. In the first sheet forming process, sheet forming was performed with the following parameters combined variously with each other. That is, the parameters to be combined with each other are a material of a metal sheet 79, an area increasing rate (%), a curvature radius ratio of the side wall portion, a curvature radius ratio of the shoulder portion, a blank holder pressure (MPa), a pad holding area, a pad pressure (MPa), a pad projecting position (%), and a blank-metal-sheet arrangement. Hereinafter, each of the above-mentioned parameters is explained in detail.

As the material of the metal sheet 79, two types of high-strength steel sheets each having ultrahigh strength and low ductility of respective cold rolled steel sheets having 980 MPa-class tensile strength and 1180 MPa-class tensile strength were used. Here, a sheet thickness was set to 1.4 mm.

The area increasing rate means an increasing rate of the area of the stretching portion of the L-shaped bent portion of the first sheet-formed part with respect to the area of an L-shaped bent portion having a product shape that corresponds to the stretching portion. The area increasing rate is an area increasing rate of the stretching portion of the side wall portion on an outer side of the L-shaped bent portion and the top portion in the first sheet-formed part with respect to the product shape, and it is preferable to set the area increasing rate in the range from 0.3% to 1.2%.

The ratio of the curvature radius of the side wall portion means the ratio of a curvature radius $R_{Bm}$ to a curvature radius $R_{Bp}$ in the side wall portion (see FIG. 6). The ratio of the curvature radius of the side wall portion is a value obtained by calculating the expression of $R_{Bm}/R_{Sp}$, and the value of 1.0 means that the side wall stretching portion is not formed. When the value is increased, the amount of stretching of the side wall stretching portion in the first sheet-formed part is increased. The ratio of the curvature radius of the side wall portion was changed in the range from 1.0 to 2.0.

The ratio of the curvature radius of the shoulder portion means the ratio of a curvature radius $R_{Sm}$ to a curvature radius $R_{Sp}$ in the shoulder portion (see FIG. 7). The ratio of the curvature radius of the shoulder portion is a value obtained by calculating the expression of $R_{Sm}/R_{Sp}$, and the value of 1.0 means that the top-portion stretching portion is not formed. When the value is increased, the amount of stretching of the top-portion stretching portion in the first sheet-formed part is increased. The ratio of the curvature radius of the shoulder portion was changed in the range from 1.0 to 2.1.

The blank holder pressure is a mean pressure in the area of the metal sheet 79 sandwiched between the first die 69 and the blank holder 61, it is preferable to set the blank holder pressure to 0.7 MPa or higher.

Figure 23A:
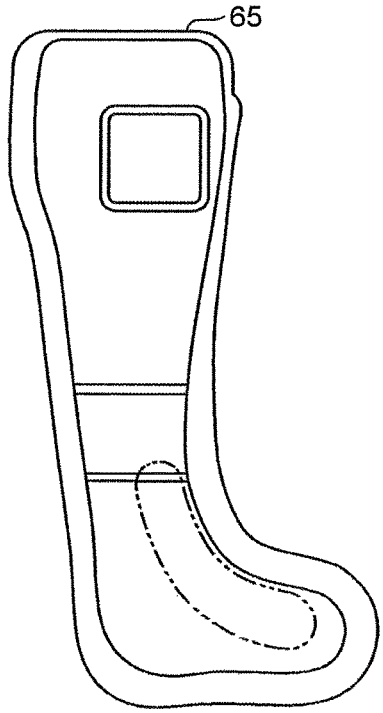
FIG. 23A is an explanatory view of a pad holding area in the first sheet forming process of the method of sheet forming according to the example of the present invention.
Figure 23B:
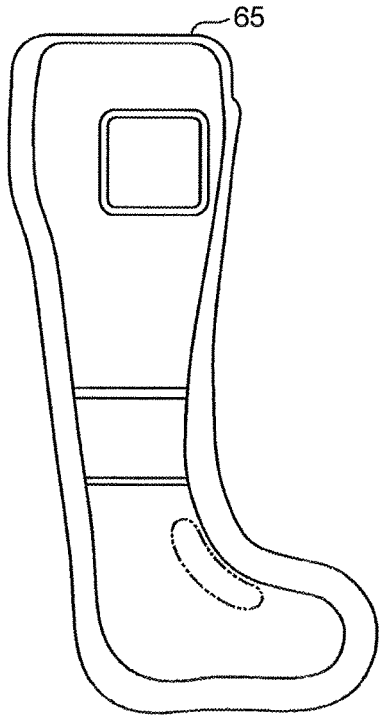
FIG. 23B is an explanatory view of the pad holding area in the first sheet forming process of the method of sheet forming according to the example of the present invention.

The pad holding area was changed by using two types of the pads 73, as illustrated in FIGS. 23A and 23B. In FIGS. 23A and 23B, each of the pad holding areas is indicated by a chain double-dashed line. The pad holding area illustrated in FIG. 23A is an area including the area corresponding to the L-shaped bent portion in the metal sheet 79, and the pad holding area illustrated in FIG. 23B is an areas of a part of the area corresponding to the bent portion. In either case, the pad holding area is set so that the top-portion stretching forming portion 67*b* of the first punch 65 (the replaceable portion 67 (see FIG. 17)) is not held. Both the areas illustrated in FIGS. 23A and 23B are set without departing from the gist of the present invention.

The pad projecting position means the position of the pad 73 in a condition that the pad 73 is arranged so that, as illustrated in FIG. 20, the first die 69 and the blank holder 61 sandwich the metal sheet 79 therebetween in a state that the pad 73 (see FIG. 19) is removed. To be more specific, the position of the pad 73 when the pad 73 is in contact with the metal sheet 79 is set as the 0% position of the pad projecting position. When the upward direction and the downward direction from a datum point that is the position of the bottom surface of the first die 69 in FIG. 20, respectively, are set as a positive direction and a negative direction, the forming depth is set as the 100% position of the pad projecting position. It is preferable that the pad projecting position be set in the range from 0% to 50%.

Figure 24A:
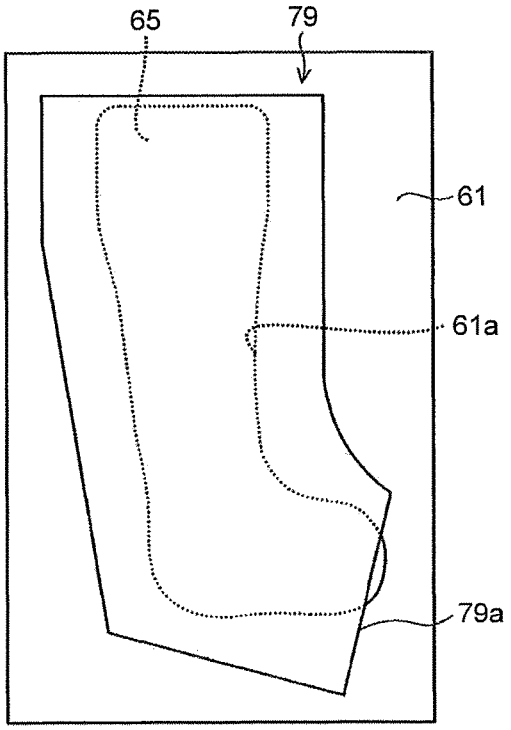
FIG. 24A is an explanatory view of an arrangement of a metal sheet in the first sheet forming process of the method of sheet forming according to the example of the present invention.
Figure 24B:
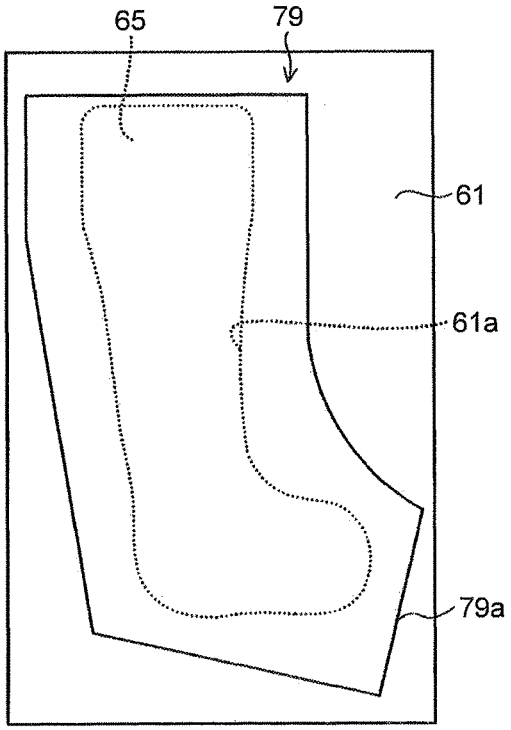
FIG. 24B is an explanatory view of an arrangement of a metal sheet in the first sheet forming process of the method of sheet forming according to a comparative example of the present invention.

The blank-metal-sheet arrangement was set to two patterns, as illustrated in FIGS. 24A and 24B. FIG. 24A illustrates the case where the metal sheet 79 is arranged so that a part 79*a* corresponding to the short side end portion of the L-shape in the metal sheet 79 does not overlap with the blank holder 61, and FIG. 24B illustrates, as a comparative example, the case where the metal sheet 79 is arranged so that the part 79*a* overlaps with the blank holder 61.

Table 1 collectively illustrates these sheet forming conditions.

TABLE 1

| Condition | Material | Area increasing rate (%)* | Ratio of curvature radius of side wall portion** | Ratio of curvature radius of a shoulder portion*** | Blank holder pressure (MPa) | Pad holding area | Pad pressure (MPa) | Pad projecting position (%) | Blank-metal-sheet arrangement |
|---|---|---|---|---|---|---|---|---|---|
| Present-invention example 1 | 1180 | 0.3 | 1.5 | 1.8 | 3.6 | FIG. 23A | 6.0 | 0 | FIG. 24A |
| Present-invention example 2 | 1180 | 1.1 | 1.9 | 2.1 | 3.6 | FIG. 23A | 6.0 | 0 | FIG. 24A |
| Present-invention example 3 | 1180 | 0.6 | 1.8 | 2.0 | 3.6 | FIG. 23A | 6.0 | 0 | FIG. 24A |
| Present-invention example 4 | 1180 | 0.6 | 1.8 | 2.0 | 0.7 | FIG. 23A | 6.0 | 0 | FIG. 24A |
| Present-invention example 5 | 1180 | 0.6 | 1.8 | 2.0 | 3.6 | FIG. 23A | 3.0 | 0 | FIG. 24A |
| Present-invention example 6 | 1180 | 0.6 | 1.8 | 2.0 | 3.6 | FIG. 23A | 6.0 | 50 | FIG. 24A |
| Present-invention example 7 | 1180 | 0.6 | 1.8 | 2.0 | 3.6 | FIG. 23A | 6.0 | 0 | FIG. 24A |
| Present-invention example 8 | 1180 | 0.6 | 1.8 | 2.0 | 3.6 | FIG. 23B | 6.0 | 0 | FIG. 24A |
| Present-invention example 9 | 980 | 0.3 | 1.5 | 1.8 | 3.6 | FIG. 23A | 6.0 | 0 | FIG. 24A |
| Present-invention example 10 | 980 | 1.1 | 1.9 | 2.1 | 3.6 | FIG. 23A | 6.0 | 0 | FIG. 24A |
| Present-invention example 11 | 1180 | 0.1 | 1.1 | 1.3 | 3.6 | FIG. 23A | 6.0 | 0 | FIG. 24A |

TABLE 1-continued

| Condition | Material | Area increasing rate (%)* | Ratio of curvature radius of side wall portion** | Ratio of curvature radius of a shoulder portion*** | Blank holder pressure (MPa) | Pad holding area | Pad pressure (MPa) | Pad projecting position (%) | Blank-metal-sheet arrangement |
|---|---|---|---|---|---|---|---|---|---|
| Present-invention example 12 | 1180 | 1.3 | 2.0 | 2.1 | 3.6 | FIG. 23A | 6.0 | 0 | FIG. 24A |
| Present-invention example 13 | 1180 | 0.6 | 1.8 | 2.0 | 0.3 | FIG. 23A | 6.0 | 0 | FIG. 24A |
| Present-invention example 14 | 1180 | 0.6 | 1.8 | 2.0 | 3.6 | FIG. 23A | 1.0 | 0 | FIG. 24A |
| Present-invention example 15 | 1180 | 0.6 | 1.8 | 2.0 | 3.6 | FIG. 23A | 6.0 | 75 | FIG. 24A |
| Comparative example 1 | 1180 | 0.6 | 1.8 | 2.0 | 3.6 | FIG. 23A | 6.0 | 0 | FIG. 24B |
| Comparative example 2 | 1180 | 0.6 | 1.8 | 2.0 | 3.6 | None | 6.0 | 0 | FIG. 24A |
| Comparative example 3 | 1180 | 0.5 | 1.0 | 2.0 | 3.6 | FIG. 23A | 6.0 | 0 | FIG. 24A |
| Comparative example 4 | 1180 | 0.6 | 1.5 | 1.0 | 3.6 | FIG. 23A | 6.0 | 0 | FIG. 24A |

In Table 1, the respective materials having the 980 MPa-class tensile strength and the 1180 MPa-class tensile strength are mentioned as 980 and 1180. The conditions described in the columns of present invention example 1 to present invention example 15 in Table 1; that is, ratio of curvature radius of side wall portion (), ratio of curvature radius of shoulder portion (*), pad holding area, and blank-metal-sheet arrangement, are set without departing from the gist of the present invention. In the conditions described in the columns of present invention example 1 to present invention example 10, area increasing rate ((%)*), blank holder pressure (MPa), pad pressure (MPa), and pad projecting position (%) are set in the range of preferable conditions. In the conditions described in the columns of comparative example 1 to comparative example 4, the numerical values of specific parameters (see the underlined parameters in Table 1) are set to respective values departing from the gist of present invention.

The first sheet forming process was performed based on each condition in Table 1 to form the first sheet-formed part, and the first sheet-formed part was further sheet-formed in the second sheet forming process to produce the second sheet-formed part. Furthermore, unnecessary portions around the second sheet-formed part were trimmed to manufacture the front pillar 51. Table 2 illustrates the evaluation result of the front pillar 51 manufactured for each sheet forming condition.

TABLE 2

| Condition | Cracks of shoulder portion | Wrinkles of top portion | Cracks of flange portion | Wrinkles of flange portion | Overall evaluation |
|---|---|---|---|---|---|
| Present-invention example 1 | Good | Excellent | Good | Excellent | Good |
| Present-invention example 2 | Good | Excellent | Good | Excellent | Good |
| Present-invention example 3 | Good | Excellent | Good | Excellent | Good |
| Present-invention example 4 | Good | Good | Good | Good | Good |
| Present-invention example 5 | Good | Excellent | Good | Excellent | Good |
| Present-invention example 6 | Good | Excellent | Good | Excellent | Good |
| Present-invention example 7 | Good | Excellent | Good | Excellent | Good |
| Present-invention example 8 | Good | Excellent | Good | Excellent | Good |
| Present-invention example 9 | Good | Excellent | Good | Excellent | Good |
| Present-invention example 10 | Good | Excellent | Good | Excellent | Good |
| Present-invention example 11 | Fair | Excellent | Good | Excellent | Good |
| Present-invention example 12 | Good | Fair | Good | Excellent | Good |
| Present-invention example 13 | Good | Fair | Good | Fair | Good |
| Present-invention example 14 | Good | Fair | Good | Excellent | Good |
| Present-invention example 15 | Good | Fair | Good | Excellent | Good |
| Comparative example 1 | Poor | Excellent | Good | Excellent | No good |
| Comparative example 2 | Good | Poor | Good | Excellent | No good |
| Comparative example 3 | Poor | Excellent | Good | Excellent | No good |
| Comparative example 4 | Poor | Excellent | Good | Excellent | No good |

Evaluation items are the cracks of the part corresponding to the shoulder portion of the first punch 65 (hereinafter, referred merely to as "shoulder portion"), wrinkles of the top portion 53, and cracks and wrinkles of the flange portion 57 (see FIG. 14). The wrinkles were visually evaluated. In Table 2, the evaluations in the following cases; that is, no wrinkle is observed, a few wrinkles within an allowance are observed, slight wrinkles are observed, and obvious wrinkles are observed, are indicated as "Excellent", "Good", "Fair", and "Poor", respectively. The cracks were also visually evaluated. In Table 2, the evaluations in the following cases; that is, no crack is observed, slight cracks are observed, and cracks are observed, are indicated as "Good", "Fair", and "Poor", respectively. Furthermore, the overall evaluations of the wrinkles and the cracks were performed. In Table 2, the evaluations in the following cases; that is, wrinkles or cracks are allowable as a product, and wrinkles or cracks are not allowable as a product, are indicated as "Good" and "No good", respectively.

As illustrated in Table 2, in present invention example 1 to present invention example 15, there exists the case that the cracks were slightly observed in the shoulder portion (present invention example 11). However, in the other examples, cracks were not observed in the shoulder portion and the flange portion 57. In the same manner as above, wrinkles were not observed in almost all present-invention examples, and obvious wrinkles were not observed in all present-invention examples. As mentioned heretofore, in all of present invention example 1 to present invention example 15, the overall evaluations were "Good", and excellent sheet forming was able to be performed.

On the other hand, in comparative example 1 to comparative example 4, the overall evaluations were "No good (poor)". In comparative example 1, the metal sheet 79 was, as illustrated in FIG. 24B, arranged so that the part 79*a* corresponding to the short side end portion in the metal sheet 79 overlapped with the blank holder 61 and hence, cracks occurred in the shoulder portion. In comparative example 2, the metal sheet 79 was not held by the pad 73 and hence, wrinkles occurred in the top portion 53. In comparative example 3, the side wall stretching portion was not formed in the first sheet-formed part and hence, cracks occurred in the shoulder portion. In comparative example 4, the top-portion stretching portion was not formed in the first sheet-formed part and hence, cracks occurred in the shoulder portion.

As mentioned above, in the present embodiment in which the present invention is applied, even when the high-strength steel sheet having low ductility and ultrahigh strength was used, the occurrence of cracks was avoided, and the occurrence of wrinkles was prevented thus manufacturing the front pillar 51 stably with sufficient precision.

The above-mentioned embodiment merely constitutes one embodiment of the present invention, and it is evident that the present invention is not limited to the embodiment, various modifications can be made depending on specifications or the like without departing from the gist of the present invention, and the other various embodiments are conceivable without departing from the gist of the present invention.

The present invention is applicable to a method for manufacturing a sheet-formed part that is formed in an L-shape as viewed in a plan view and includes a top portion, side wall portions formed on the respective both sides of the top portion, and the flange portions contiguously formed with the respective side wall portions, by sheet-forming a metal sheet with the use of a sheet forming tool.

REFERENCE SIGNS LIST

1 first sheet forming tool
3 first punch
5 first die
5*a* forming surface
5*b* pad housing portion
5*c* sandwiching surface
7 blank holder
7*a* punch housing portion
9 pad
11 metal sheet
11*a* part corresponding to short side end portion of L-shape
13 second sheet forming tool
15 second punch
15*a* forming surface
17 second die
17*a* forming surface
19 sheet-formed part
21 top portion
21*a* convex portion
21*b* connection portion
23 side wall portion
25 flange portion
27 first sheet-formed part
29 side-wall stretching portion
31 top-portion stretching portion
33 bolster
35 slider
37 cushion pin
39 spring
41 top-portion forming surface portion
41*a* top-portion stretching forming portion
43 side-wall forming surface portion
43*a* side-wall stretching forming portion
51 front pillar
53 top portion
55 side wall portion
57 flange portion
59 cushion pin
61 blank holder
61*a* punch housing portion
63 replaceable portion
65 first punch
67 replaceable portion
67*a* side-wall stretching forming portion
67*b* top-portion stretching forming portion
69 first die
69*a* recessed portion
69*b* pad housing portion
71 replaceable portion
73 pad
75 second punch
77 second die
77*a* recessed portion
79 metal sheet
79*a* part corresponding to short side end portion of L-shape

The invention claimed is:

1. A method of sheet forming for manufacturing a sheet-formed part that is formed in an L-shape as viewed in a plan view and includes a top portion, side wall portions formed on the respective both sides of the top portion, and flange portions contiguously formed with the respective side wall portions, by sheet-forming a metal sheet with a sheet forming tool, the method comprising:

a first sheet forming process in which the metal sheet is arranged on a first sheet forming tool including a first punch, a first die, a first blank holder, and a pad so that a part corresponding to an end portion of a short side of the L-shape in the metal sheet does not overlap with the first die and the first blank holder, a part of the top portion is held by the pad, and the metal sheet is sheet-formed into a first sheet-formed part having an intermediate shape; and a second sheet forming process in which the first sheet-formed part formed in the first sheet forming process is sheet-formed into a second sheet-formed part having a top portion and a side wall portion whose shapes are identical with those of the sheet-formed part, with a second sheet forming tool having a second punch and a second die, wherein the side wall portion on an outer side that includes an L-shaped bent portion in the first sheet-formed part formed in the first sheet forming process is outwardly stretched in an arcuate shape as viewed in a plan view from the side wall portion of the sheet-formed part, a curvature radius of a circular arc of the side wall portion stretched in an arcuate shape is larger than a curvature radius of the L-shaped bent portion of the sheet-formed part, an outside of the top portion of the L-shaped bent portion is stretched from an outside of the top portion of the sheet-formed part, and a curvature radius in a cross section of a shoulder portion contiguously formed with the top portion stretched, as viewed in a side view, is larger than a curvature radius in a cross section of a shoulder portion contiguously formed with the outside of the top portion of the L-shaped bent portion of the sheet-formed part, as viewed in a side view.

2. The method of sheet forming according to claim 1, wherein a part of the top portion held by the pad in the first sheet forming process includes at least the L-shaped bent portion, and is a part with which a stretching portion of the top portion in the first sheet-formed part does not interfere.

3. The method of sheet forming according to claim 2, wherein a timing at which the pad is started to hold the metal sheet in the first sheet forming process is the timing at which the pad is positioned in a range from 0% position to 50% position with respect to a forming depth from a position where the first punch initiates a contact with the metal sheet to a bottom dead center position of the first punch.

4. The method of sheet forming according to claim 3, wherein amounts of stretching of the side wall portion and the top portion in the first sheet forming process are each an amount that an area ratio of an area of a stretching portion of the L-shaped bent portion of the first sheet-formed part to an area of the L-shaped bent portion of the sheet-formed part corresponding to the stretching portion is increased by 0.3% to 1.2%.

5. The method of sheet forming according to claim 2, wherein amounts of stretching of the side wall portion and the top portion in the first sheet forming process are each an amount that an area ratio of an area of a stretching portion of the L-shaped bent portion of the first sheet-formed part to an area of the L-shaped bent portion of the sheet-formed part corresponding to the stretching portion is increased by 0.3% to 1.2%.

6. The method of sheet forming according to claim 1, wherein a timing at which the pad is started to hold the metal sheet in the first sheet forming process is the timing at which the pad is positioned in a range from 0% position to 50% position with respect to a forming depth from a position where the first punch initiates a contact with the metal sheet to a bottom dead center position of the first punch.

7. The method of sheet forming according to claim 6, wherein amounts of stretching of the side wall portion and the top portion in the first sheet forming process are each an amount that an area ratio of an area of a stretching portion of the L-shaped bent portion of the first sheet-formed part to an area of the L-shaped bent portion of the sheet-formed part corresponding to the stretching portion is increased by 0.3% to 1.2%.

8. The method of sheet forming according to claim 1, wherein amounts of stretching of the side wall portion and the top portion in the first sheet forming process are each an amount that an area ratio of an area of a stretching portion of the L-shaped bent portion of the first sheet-formed part to an area of the L-shaped bent portion of the sheet-formed part corresponding to the stretching portion is increased by 0.3% to 1.2%.

* * * * *